United States Patent [19]

Holley

[11] 4,225,429

[45] Sep. 30, 1980

[54] VEHICLE FOR CLEANING RAILWAY ROADBEDS OF MAGNETIC ARTICLES

[76] Inventor: John D. Holley, 3145 Rolling Rd., Montgomery, Ala. 36111

[21] Appl. No.: 954,103

[22] Filed: Oct. 24, 1978

[51] Int. Cl.[2] ..... B03C 1/00

[52] U.S. Cl. ..... 209/215; 209/219; 104/1 R; 104/279; 198/510; 198/690

[58] Field of Search ..... 209/215, 218, 219, 38, 209/420, 421; 214/353, 83.26, 500-522; 171/16; 198/510, 506, 690, 312, 314-316; 37/104; 104/1 R, 2, 17 R, 279, 45

[56] References Cited

U.S. PATENT DOCUMENTS

| | | | |
|---|---|---|---|
| 2,505,501 | 4/1950 | Miller et al. | 15/55 |
| 2,599,838 | 6/1952 | Kandoll | 214/83.26 |
| 3,157,267 | 11/1964 | Asbury | 198/506 X |
| 3,552,320 | 1/1971 | Traupmann | 104/2 X |
| 3,690,264 | 9/1972 | Plasser et al. | 104/17 R |
| 3,720,299 | 3/1973 | Wegmann et al. | 198/308 X |
| 3,731,455 | 5/1973 | Theurer | 104/1 R X |
| 4,094,249 | 6/1978 | Theurer et al. | 171/16 X |

*Primary Examiner*—Ralph J. Hill
*Attorney, Agent, or Firm*—William B. Kerkam, Jr.

[57] ABSTRACT

A vehicle for cleaning a railway roadbed of magnetic articles such as spikes, tie plates, rail support plates, bolts, and the like has a chassis supported by rail engaging wheels which are rotated by a hydraulic motor powered by an internal combustion engine driven pump mounted on the chassis. At least one endless conveyor of non-magnetic flexible material is mounted on the chassis with a lower end thereof adjacent the roadbed and passing over a lower drum supporting fixed magnets. The conveyor is driven by a hydraulic motor powered by the pump to move at the same speed as the vehicle to prevent scuffing over the ballast of the roadbed. The endless conveyor is provided with spaced parallel cleats across the conveyer whereby metallic articles attracted by the magnets acting through the conveyor will engage the articles and move them along the conveyor out of the field of action of the magnets. The conveyor discharges into a hopper mounted on the vehicle with the hopper having a bottom formed of an endless conveyor driven by a hydraulic motor powered by the pump so that the hopper may be discharged laterally from either side of the vehicle. The vehicle may be provided with auxiliary pneumatic wheels or crawlers to support the vehicle when a rail of the track has been removed for replacement and may also be provided with auxiliary rail engaging wheels for supporting the vehicle on a narrow gauge track when both of the main rails have been removed for replacement. A turntable may be mounted on and beneath the vehicle to engage the roadbed for lifting the vehicle to position the vehicle for the desired direction of motion along the roadbed. Suitable hydraulic systems are provided for driving the vehicle and the conveyor as well as for actuating the hopper dump conveyor, crawler lifts, conveyor lifts, turntable and conveyor traverse motor when the conveyor is mounted to move laterally across the vehicle.

4 Claims, 12 Drawing Figures

FIG. 8.
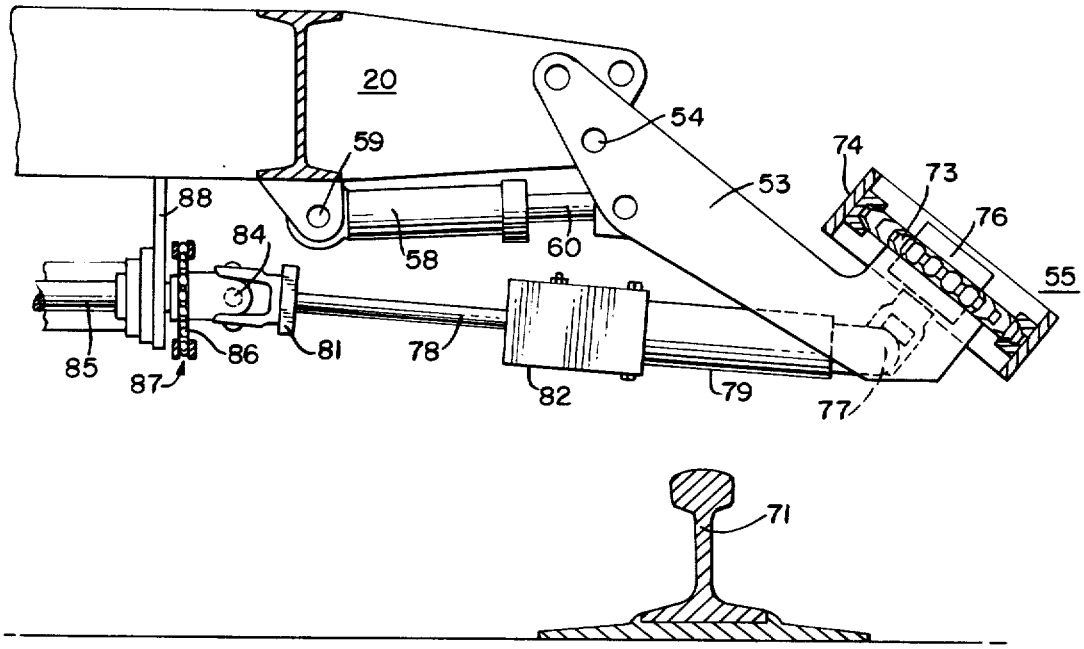
FIG. 9.
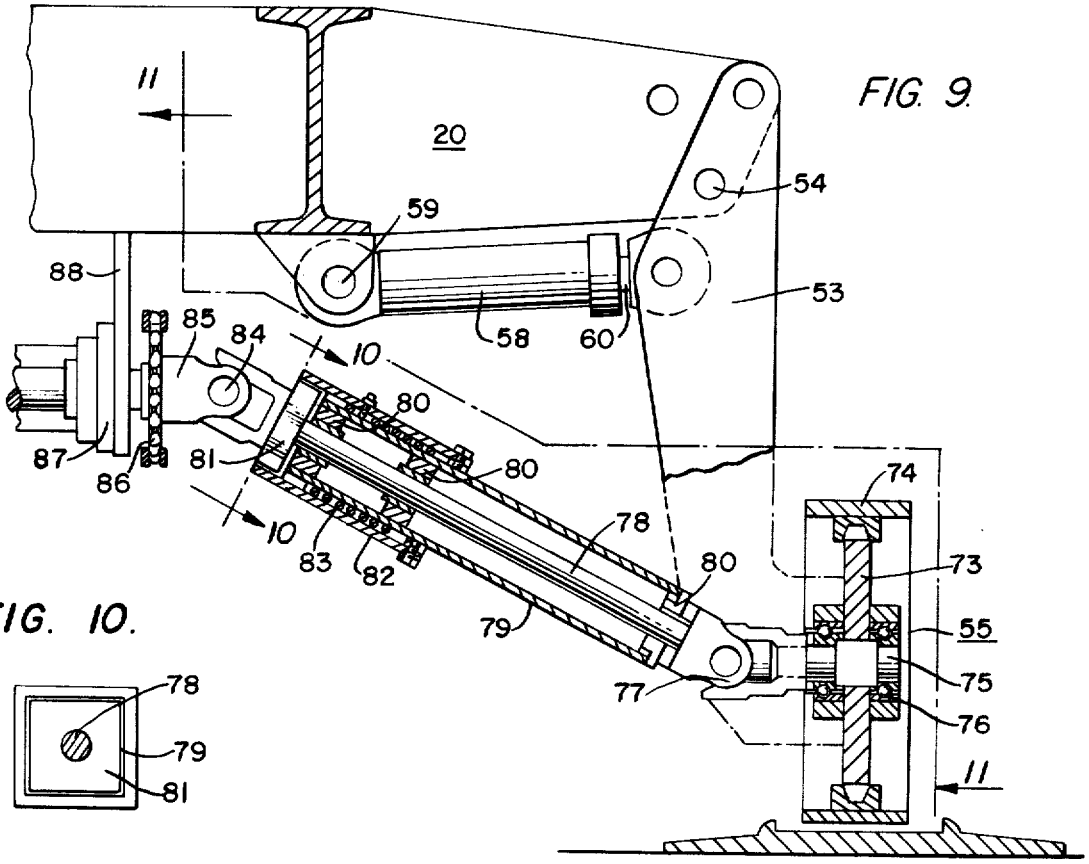
FIG. 10.

VEHICLE FOR CLEANING RAILWAY ROADBEDS OF MAGNETIC ARTICLES

BACKGROUND OF THE INVENTION

Heretofore railway roadbed cleaners have been proposed as in the expired Miller et al U.S. Pat. No. 2,505,501 of Apr. 25, 1950 in which a vehicle is provided with wheels for engaging the rails of a railway and with rotary brushes for engaging the surface of the roadbed to brush foreign objects onto conveyors for deposit into a hopper carried by the vehicle.

U.S. Pat. No. 3,401,365 to Grader et al of Sept. 10, 1968 and U.S. Pat. No. 3,249,211 to Gray of May 3, 1966 both show magnetic railway track cleaners utilizing magnets to pick up magnetic articles from the roadbed.

U.S. Pat. Nos. 3,157,267 and 3,232,408 to Asbury disclose roadway signal device retrievers in which an endless conveyor of non-magnetic material rotates about a lower drum driven by supporting wheels with the drum including permanent magnets and with the conveyor discharging into a towing truck to pick up signal devices having a base of magnetic material.

The present invention provides unexpected advantages and unexpected flexibility of operation over this prior art for use with all existing methods of railway track laying and railway track replacement particularly with modern endless welded rails.

SUMMARY OF THE INVENTION

To provide a flexible and efficient rail vehicle for cleaning magnetic articles from the roadbed and for use in all modern methods of railroad rail placement and replacement, the present invention comprises a chassis mounted on railway wheels for use on permanent or temporary track with the wheels driven hydraulically by a motor driven pump mounted on the chassis, the pump also driving a hydraulic motor which actuates at least one endless conveyor mounted on the vehicle and disposed at an angle to the direction of motion of the vehicle with the speed of the endless conveyor and the speed of the vehicle coordinated to prevent scuffing over the roadbed, a lower drum around which the endless conveyor moves adjacent the roadbed being provided with permanent magnets which act through the surface of the conveyor to lift magnetic articles from the roadbed onto the conveyor, the conveyor including spaced parallel cleats on the surface thereof to carry the magnetic articles upwardly on the conveyor out of the field of influence of the magnets, the endless conveyor discharging at its upper end into a hopper on the chassis provided with a conveyor bottom which is actuated by a hydraulic motor powered by the pump and discharging selectively on either side of the vehicle when the hopper has received a desired load of magnetic articles, said endless conveyor being optionally mounted on tracks disposed across the chassis with hydraulic motor means powered by the pump for moving the conveyor across the chassis, the endless conveyor having hydraulic means powered by the pump for lifting it out of position adjacent the roadbed, and above the chassis, hydraulically and selectively actuated auxiliary support means are mounted on the chassis and are moveable into position to support the vehicle in the absence of a rail or rails, means connected to the drive for the wheels drive the auxiliary support means to move the vehicle in the desired direction and, optionally, a hydraulically actuated turntable is mounted on and beneath the chassis for lifting the vehicle from the tracks and/or auxiliary support means for rotating the vehicle for movement in a desired direction along the roadbed.

BRIEF DESCRIPTION OF THE DRAWINGS

In the accompanying drawings, in which like reference characters indicate like parts, a preferred embodiment of the present invention is shown together with two modifications thereof and in which

FIG. 8 is an enlarged view of a portion of the embodiment of FIG. 1 showing a crawler in raised position;

FIG. 9 is a view similar to that of FIG. 8 showing a crawler in ground engaging position;

FIG. 10 is a cross-sectional view on the line 10—10 of FIG. 9;

DESCRIPTION OF THE PREFERRED EMBODIMENTS

Figure 1:
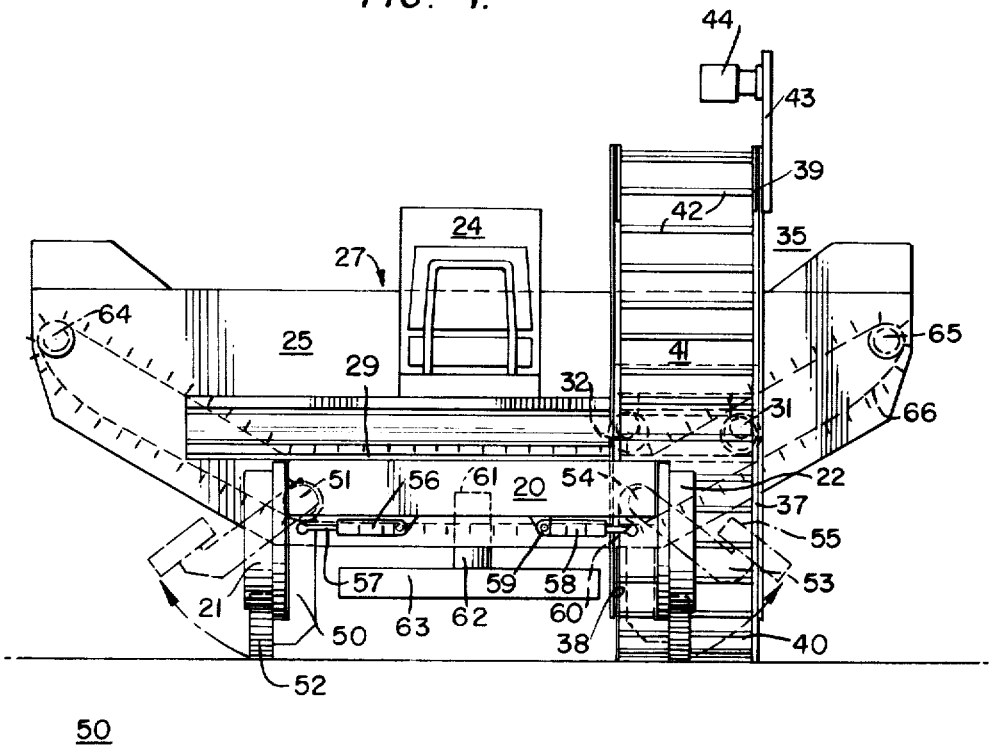
FIG. 1 is a view from the rear of a preferred embodiment of the present invention.

With particular reference to FIGS. 1, 2, 6, 7, 8, 9, 10 and 11, the preferred embodiment of the vehicle of the present invention has a chassis 20 supported by rail engaging rear wheels 21 and 22 and front wheels 23 and is further provided with an operator's station 24 for location of the various hydraulic controls for the mechanisms as will hereinafter be described.

As particularly seen in FIG. 2, spaced bulkheads 25 and 26 mounted on and across chassis 20 form a hopper 27 the structure of which will be described hereinafter in more detail. Bulkhead 25 supports track elements 28 disposed laterally across chassis 20 and spaced from track 28 rearwardly and parallel thereto is track 29 also mounted across chassis 20. Carriage 30 is provided with spaced rollers 31 engaging track elements 28 and is further provided with rollers 32 mounted on track 29 so that carriage 30 may move laterally across chassis 20 from one side thereof to the opposite side. Hydraulic motor 33 drives one of rollers 32 to move carriage 30 along tracks 28 and 29.

Carriage 30 is provided with spaced parallel upstanding sides 34 between which an endless conveyor generally indicated at 35 is pivotally mounted at 36.

Conveyor 35 has spaced side elements 37 and 38 between which at the upper end a pulley or roller 39 is mounted for rotation. At the lower end of side elements 37 and 38 a pulley or roller 40 is mounted for rotation. An endless conveyor belt of non-magnetic material 41 extends between and around rollers 39 and 40 and is provided with spaced parallel cross cleats 42. Arm 43 is mounted at the upper end of side 37 and carries hydraulic motor 44 which through suitable means such as belt or chain 45 drives belt 41 of conveyor 35 in a clockwise rotation as seen in FIG. 2.

Lower pulley or roller 40 is provided with a plurality of spaced transverse pockets 46 parallel to the axis of rotation thereof and a permanent magnet 47, extending across roller 40, is mounted in each of pockets 46. Conveyor belt 41, in passing around roller 40, passes over the plurality of magnets 47 as the vehicle moves in the direction of the arrow in FIG. 2.

A hydraulic cylinder 48 is pivotally mounted on carriage 30 and includes a piston and piston rod 49 for rotating conveyor 35 about pivot 36 to lift roller 40 clear of the roadbed and also clear of the upper surface of chassis 20 when conveyor 35 is to be moved from one side of the chassis to the other on tracks 28 and 29.

In modern track laying practice, and in modern track replacement practice, it is conventional to lay one rail at a time or replace one rail at a time so that while one side of the vehicle of the embodiment of FIG. 1 will be carried by its wheels on the existing rail, the other side of the vehicle will have no rail for support of the wheels on that side. Accordingly, means must be provided for supporting the vehicle and for moving the vehicle on that side on which no rail is present. To this end, a frame 50 is pivoted at 51 on one side of chassis 20 and mounts thereon a conventional crawler mechanism 52 and a similar frame 53 is pivoted at 54 on the other side of chassis 20 and carries conventional crawler mechanism 55. Frame 50 and its associated crawler mechanism 52 can be swung into and out of ground engaging position by hydraulic cylinder 56 pivotally mounted beneath chassis 20 and having a piston and piston rod 57 pivotally connected to frame 50. Frame 53 is similarly actuated to bring its crawler mechanism 55 into and out of ground engaging position by a hydraulic cylinder 58 pivoted at 59 beneath chassis 20 and having a piston and piston rod 60 pivotally connected to frame 53.

A cylinder 61 is mounted at the center of gravity of chassis 20 and has a downwardly extended piston 62 which is connected to a flat table 63 which when in lowered position engages the roadbed to lift the vehicle from the rails and from the roadbed for rotation of the vehicle for reverse movement along the rail or rails.

Roller 64 is mounted between bulkheads 25 and 26 on the left of the vehicle as seen in FIG. 1 and roller 65 is mounted opposite thereto on the right side of the vehicle in FIG. 1 between these bulkheads. An endless conveyor extends between rollers 64 and 65 and is indicated at 66 which endless conveyor forms the bottom of hopper 27. Hydraulic motors 67 (FIG. 2) drive roller 64 and/or 65 selectively in either direction to move endless conveyor 66 to discharge the contents of hopper 27 on either side of the vehicle as desired.

Figure 2:
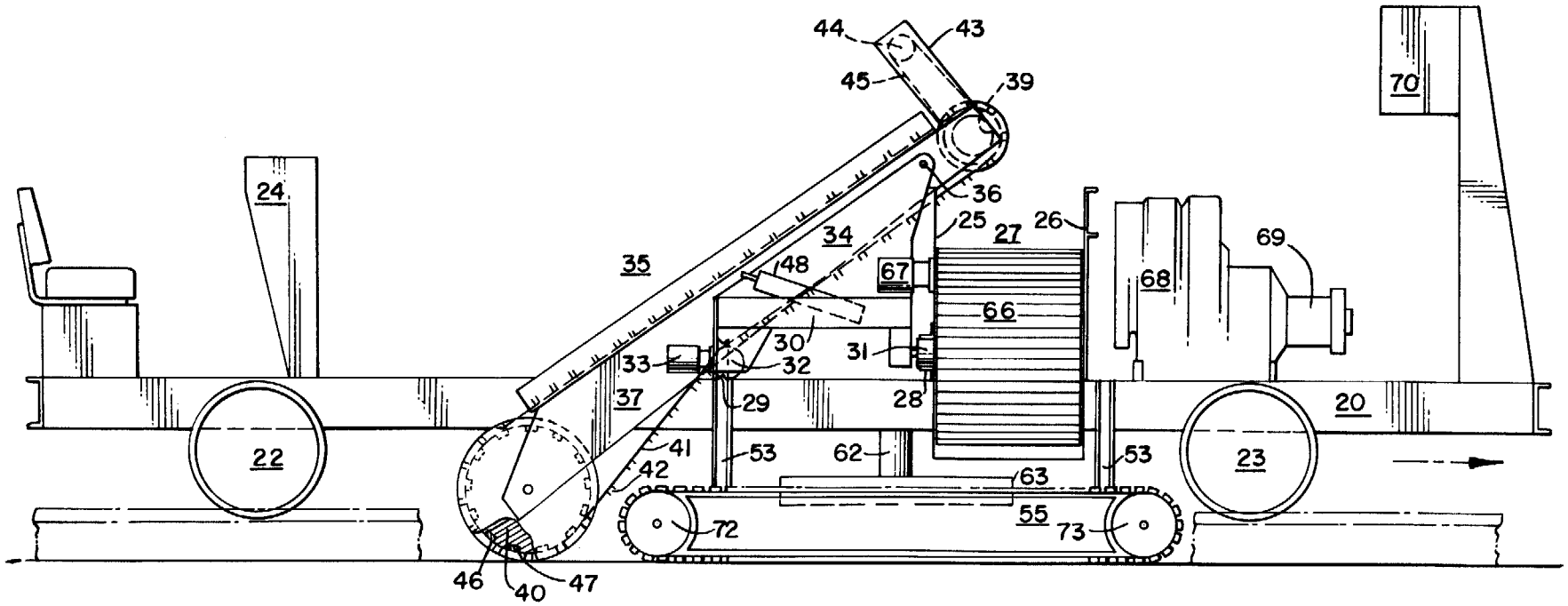
FIG. 2 is a side view from the right of the embodiment of FIG. 1.

As seen in FIG. 2 an internal combustion engine 68 mounted on chassis 20 drives hydraulic pump 69 to provide hydraulic fluid under pressure to the various hydraulically actuated components of the vehicle as will more fully appear hereinafter and a reservoir for the hydraulic fluid is shown at 70 in FIG. 2.

FIGS. 8, 9, 10 and 11 show in enlarged detail the structure for raising and lowering crawler 55 and for driving crawler 55 to move the vehicle when crawler 55 is in ground engaging position. In FIG. 8 crawler 55 is in raised position and the vehicle is supported by its wheels on rail 71. In FIG. 9 rail 71 has been removed and crawler 55 is in ground engaging position to support the vehicle and to drive it in its path of movement. It will, of course, be understood that the following description of the mechanism for actuating crawler 55 is identical to that of crawler 52. It would therefore be redundant to repeat the description for crawler 52.

Crawler 55 has a rear sprocket 72 and a forward sprocket 73 in known manner and the several links of the crawler track are mounted endlessly around sprockets 72 and 73 with one link of the track shown at 74. Sprocket 73 is mounted on shaft 75 carried in bearing 76 which in turn is mounted on frame 53. The inboard end of shaft 75 carries universal joint 77. Shaft 78 is connected to universal joint 77 and housing 79, which is square in cross-section (FIG. 10), surrounds shaft 78 and is spaced therefrom by bearings 80. A square end 81 is mounted on shaft 78 and is received within housing 82, which is square in cross section, to mate with end 81. A spring 83 is mounted around housing 79 and within housing 82 so that housing 82 may retract against squared end 81 until relative rotation between these two parts causes the two square sections to align whereupon spring 83 engages the two units to act as a clutch.

A universal joint 84 is mounted on square end 81 and its shaft 85 mounts sprocket 86. Shaft 85 is supported in suitable bearings 87 mounted on extension 88 of chassis 20. Shaft 85 extends across the vehicle to the identical actuating and driving mechanism for crawler 52. Sprocket 86 is driven by chain 87 which in turn is driven by sprocket 88 secured to axle 89 for the front chassis wheels 23. Axle 89 is suitably mounted on chassis 20 and is rotated by gear box 90 also mounted on chassis 20. Gear box 90 is powered by shaft 91 connecting to universal joint 92 which in turn is connected to the driven shaft 93 of main hydraulic motor 94 which motor provides the motive power for the vehicle.

Figure 6:
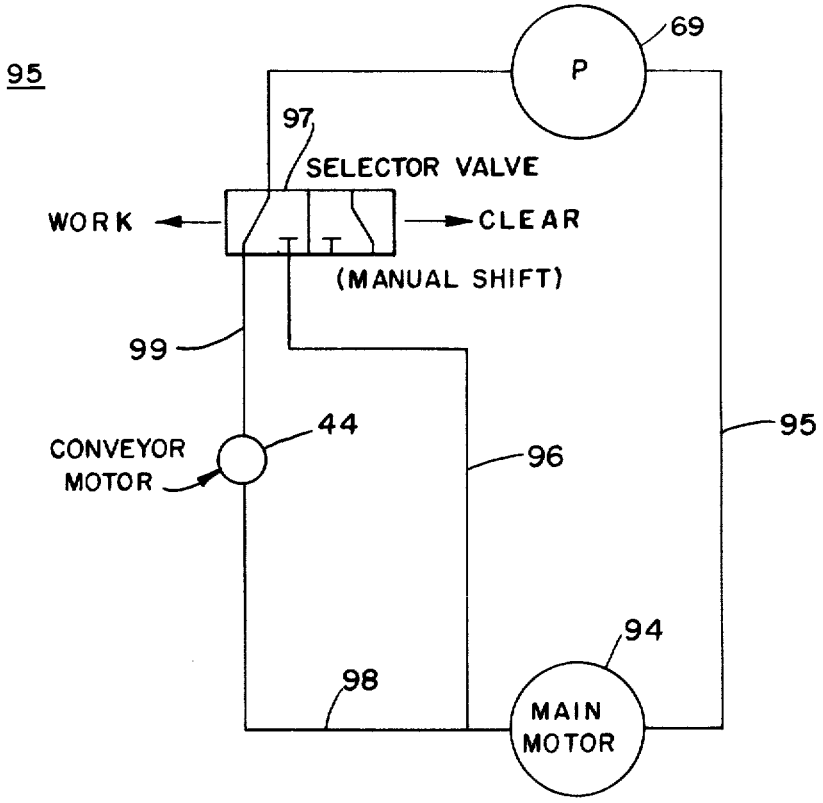
FIG. 6 is a hydraulic circuit diagram of the driving circuit for the several embodiments including the main drive motor for the vehicle and the motor for driving the magnetic article pickup conveyors.
Figure 7:
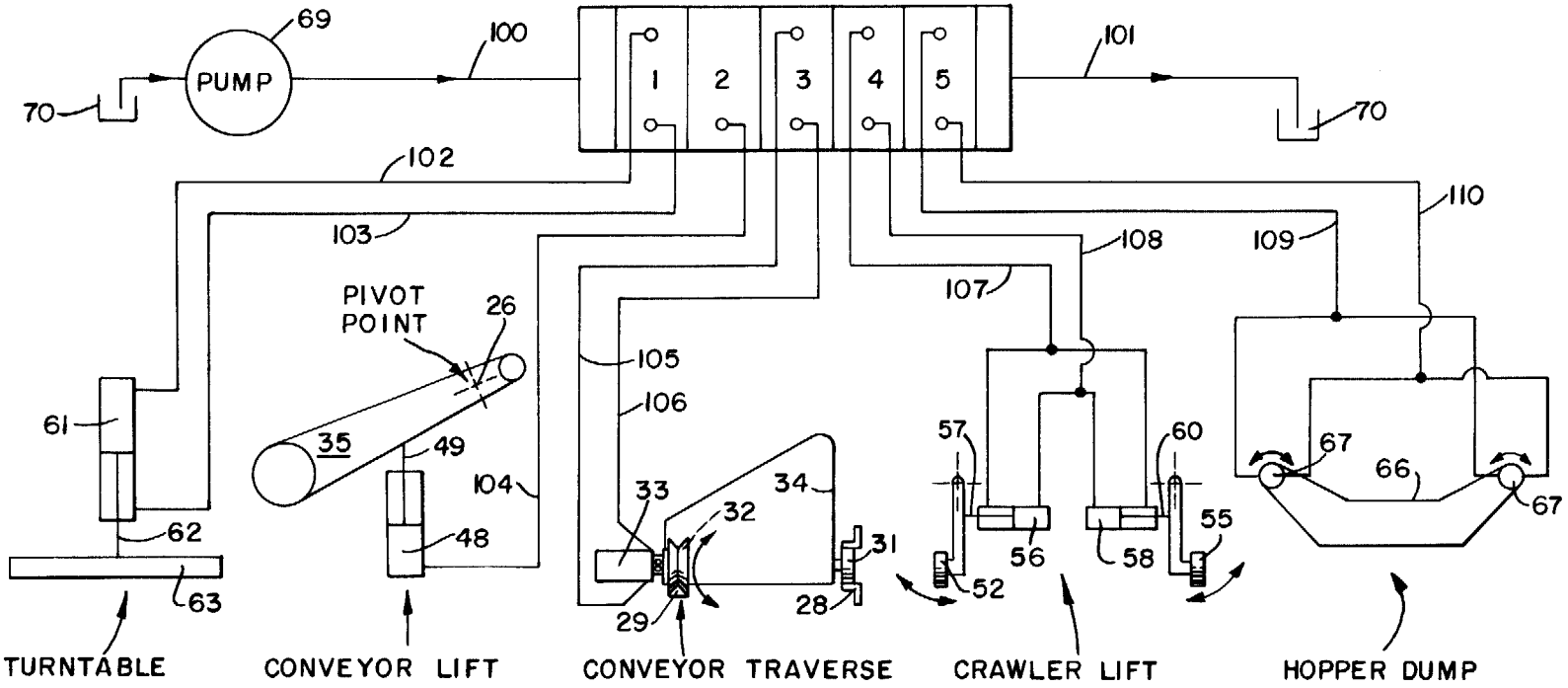
FIG. 7 is a hydraulic circuit diagram for actuating the several components of the embodiment of FIG. 1.
Figure 11:
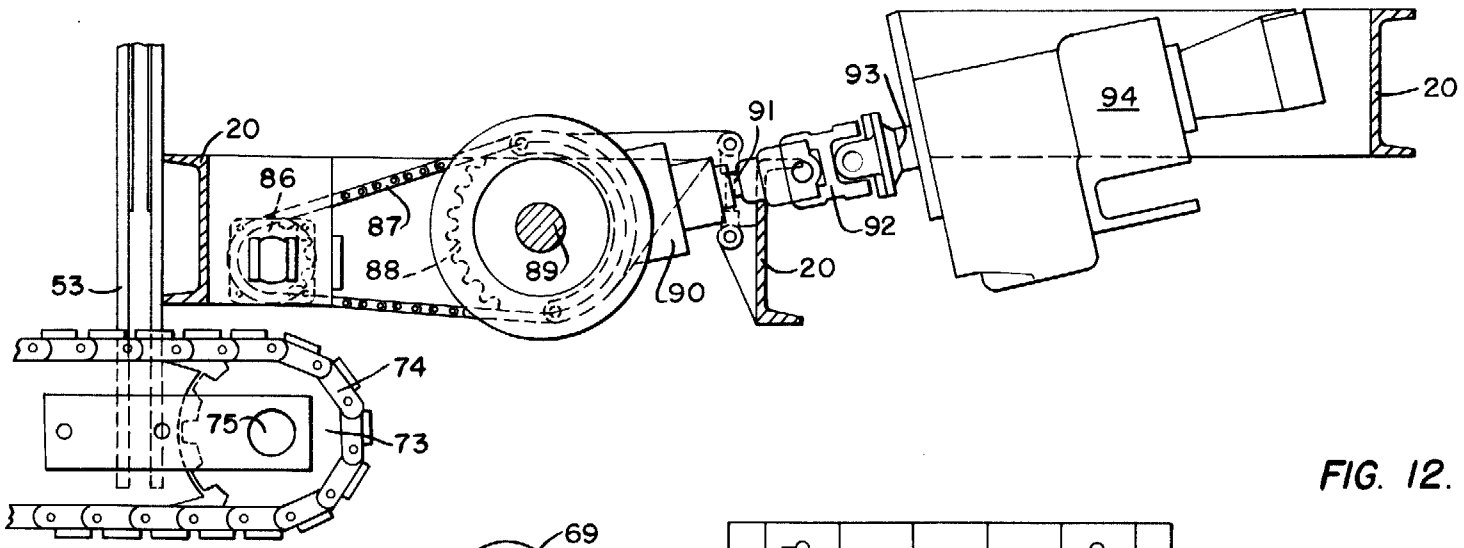
FIG. 11 is an enlarged detail on the line 11—11 of FIG. 9 showing the drive for a crawler.

FIGS. 6 and 7 show hydraulic circuitry suitable for use with the preferred embodiment of FIGS. 1 and 2. The manually actuable valves in the circuits to be described hereinafter are located at the operator's position 24 for ready control of all of the elements of the vehicle. Pump 69 of FIG. 6, which is driven by internal combustion engine 68, provides hydraulic fluid under pressure through pipe 95 to main motor 94 for driving the vehicle in its forward motion and for driving either crawler 52 or 55 when in use. When conveyor 35 for picking up magnetic articles is not in use and is raised out of proximity to the roadbed, motor 94 is connected by pipe 96 through valve 97 to pump 69. When conveyor 35 is in lowered position for picking up magnetic articles from the roadbed, conveyor motor 44 is connected by pipe 98 to discharge from motor 94 and exhausts through pipe 99 and valve 97 to pump 69. Main motor 94 and conveyor motor 44 with their respective drives are so constructed and arranged that the speed of the vehicle is the same as the speed of conveyor belt 41 to prevent belt 41 from scuffing over the roadbed while in motion.

The hydraulic circuit of FIG. 7 actuates the various mechanical structures of the preferred embodiment of FIGS. 1 and 2 other than the drive for the vehicle and the drive for the magnetic article pickup conveyor 35. In this hydraulic circuit pump 69 receives hydraulic fluid from reservoir 70 and provides hydraulic fluid under pressure through pipe 100 to manually actuable valves 1, 2, 3, 4 and 5 located at the operator's position 24 and valves 1-5 can discharge through pipe 101 back to reservoir 70. By suitable actuation of valve 1 turntable 63 can be raised or lowered by cylinder 61 and piston 62 energized through pipes 102 and 103.

Valve 2 controls cylinder 48 and piston 49 through pipe 104 to raise and lower conveyor 35 into and out of operating position.

Valve 3 acting through pipes 105 and 106 energizes motor 33, when desired, to move carriage 30 and conveyor 35, when in raised position, from one side of the chassis 20 to the other depending on the side of the roadbed to be cleaned.

Valve 4 selectively controls through pipes 107 and 108 cylinders and pistons 56 and 58 to selectively raise and lower crawlers 52 and 55 to support and drive the vehicle when the adjacent rail has been removed.

Valve 5 through pipes 109 and 110 supplies hydraulic fluid under pressure to motor 67 for conveyor 66 to empty hopper 27 on a selected side of the vehicle.

Figure 3:
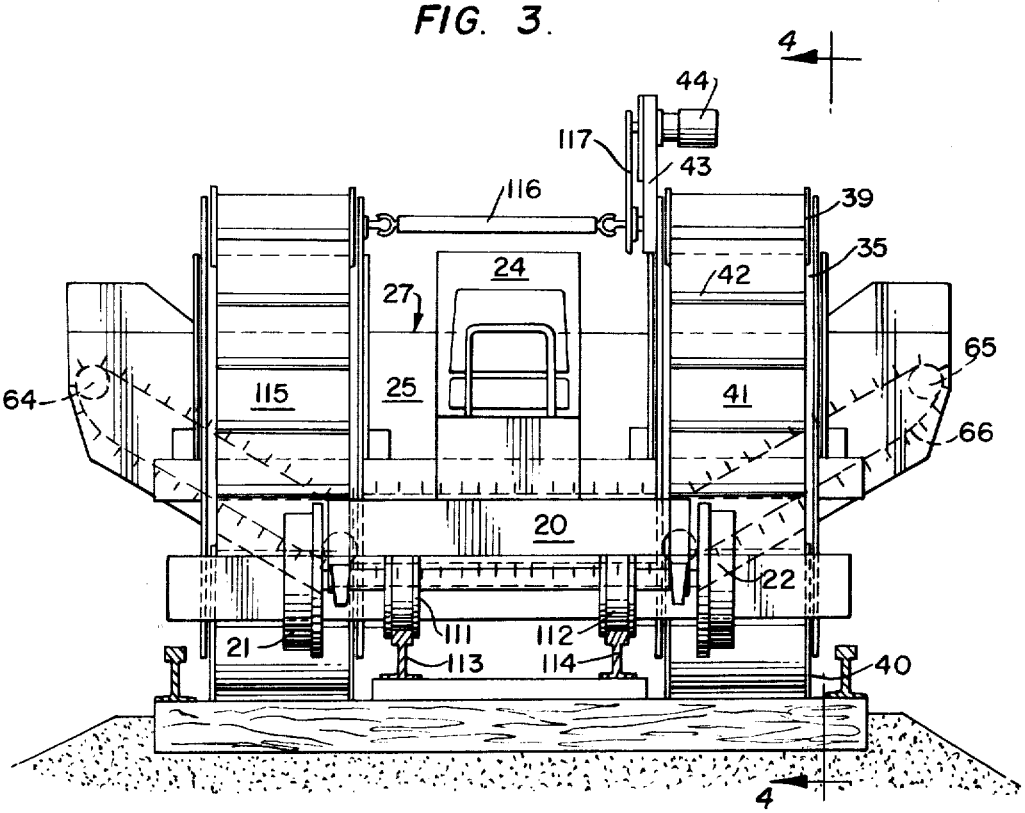
FIG. 3 is a view from the rear of a modification of the embodiment of FIG. 1 having two metallic article pickup conveyors.
Figure 4:
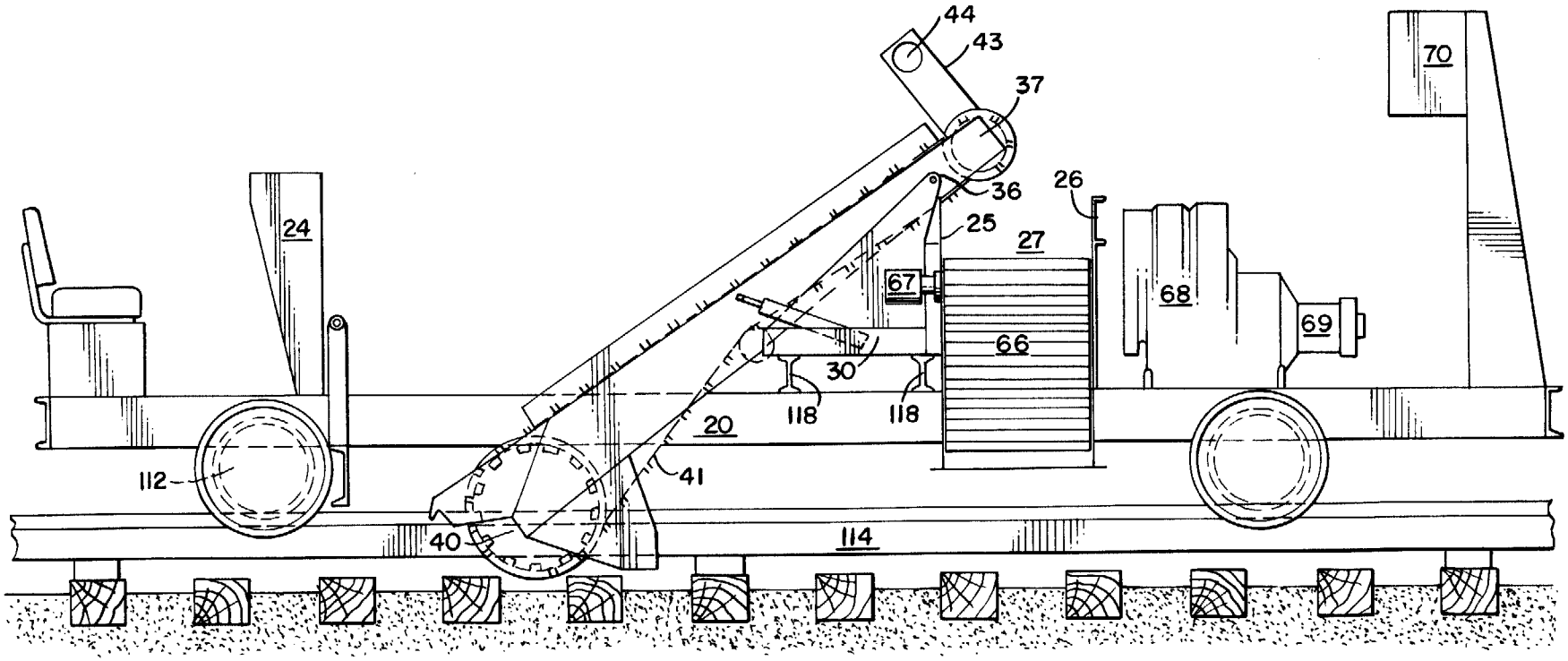
FIG. 4 is a side elevation from the right of the embodiment of FIG. 3.

The embodiment of FIGS. 3 and 4 is utilized when both rails of the railroad track are to be renewed at the same time. A narrow gauge track is then laid between the rails to be replaced to carry the necessary equipment and the old rails are moved outwardly therefrom as seen in FIG. 3. Under such circumstances the vehicle of the present invention is provided on its front and rear axles with smaller diameter wheels such as wheels 111 and 112 on narrow gauge spacing to move the vehicle over the narrow gauge rails 113 and 114. Further under these circumstances it is possible to pick up simultaneously magnetic articles on each side of the roadbed and for this purpose the left side of the vehicle as seen in FIG. 3 is provided with a second conveyor 115 identical in construction and in operation to conveyor 35. Conveyor 35 is then fixed in position and is not mounted to move across the vehicle as in the embodiment of FIG. 1. Both conveyors 35 and 115 can be raised and lowered in exactly the same manner as conveyor 35 in the embodiment of FIGS. 1 and 2. Conveyor 115 is driven in synchronism with conveyor 35 by utilizing a cross shaft 116 driven by motor 44 through a drive 117 which also drives conveyor 35.

As seen in FIG. 4, the embodiment of FIG. 3 involves a simplified construction for support of each conveyor 35 and 115 in that carriage 30, instead of being mounted on tracks and moved by a drive motor 33, is mounted on fixed supports 118 secured to chassis 20.

Figure 5:
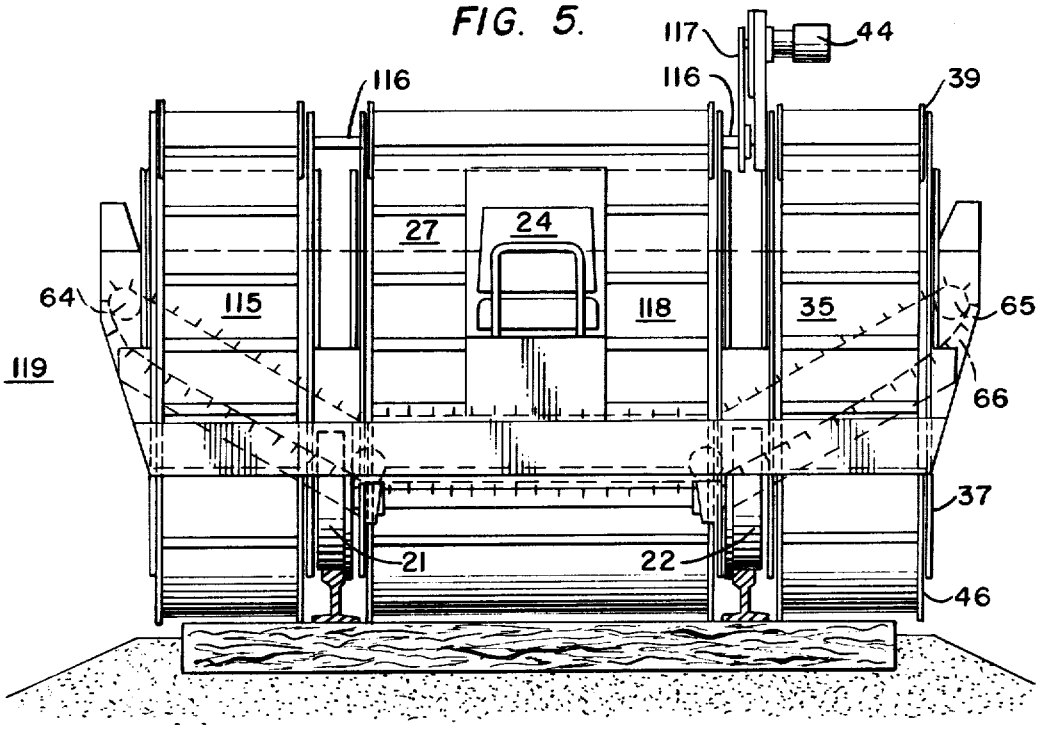
FIG. 5 is a view from the rear of another modification of the embodiment of FIG. 1 having three magnetic article pickup conveyors.
Figure 12:
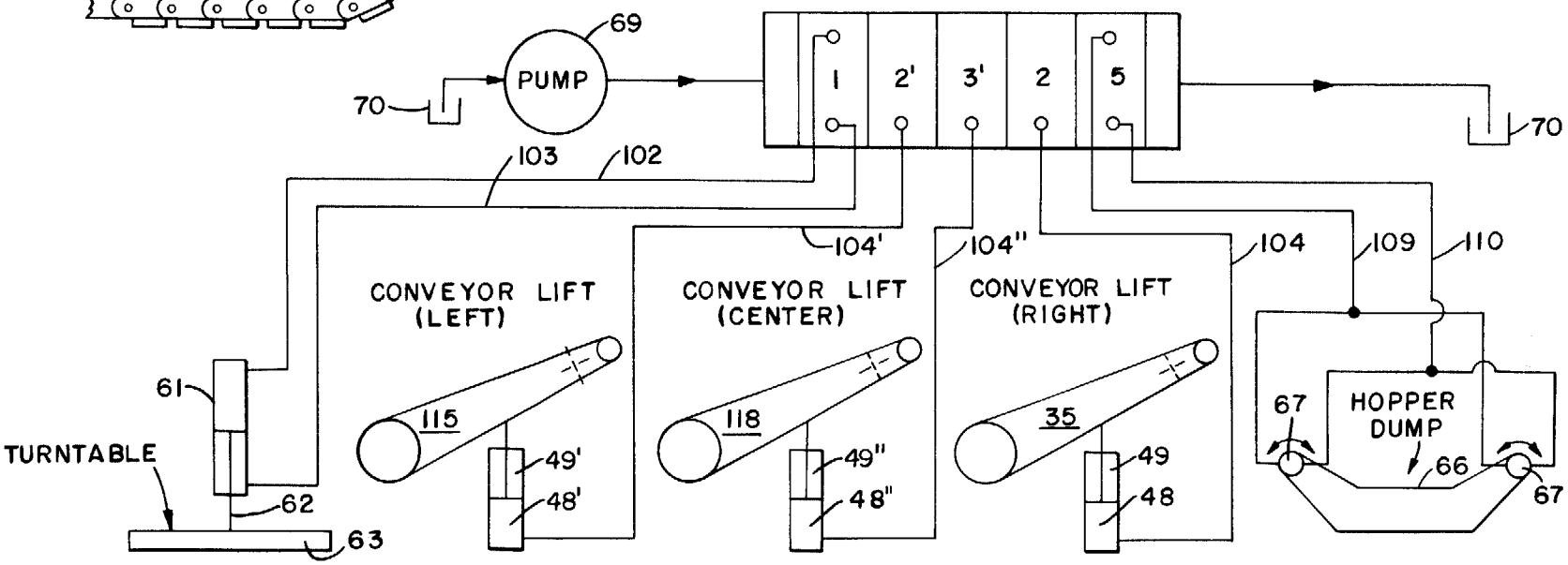
FIG. 12 is a hydraulic diagram for actuating the components of the embodiments of FIGS. 3 and 5.

A turntable such as turntable 63 of the embodiment of FIGS. 1 and 2 may be used with the embodiment of FIG. 4 and is shown in the hydraulic circuit of FIG. 12 which hydraulic circuit may be used with the embodiments of FIGS. 3 and 5.

The embodiment of FIG. 5 is utilized on existing rails to clean the surface of the roadbed inside and outside the rails. In this embodiment there are three endless conveyors for picking up magnetic articles constructed exactly in the manner of conveyor 35 of the embodiment of FIGS. 1 and 2 and the conveyors 35 and 115 of the embodiment of FIG. 3 with a central conveyor 118 disposed between conveyors 35 and 115 and extending over the space between the rails. In this embodiment shaft 116 extends entirely across the vehicle and drives all three conveyors synchronously and in turn is driven by motor 44 through belt or chain 117. Each of the three conveyors empties into hopper 27 and the contents of hopper 27, as before, are selectively discharged from either side of the vehicle by the conveyor 66.

A simplified hydraulic system as shown in FIG. 12 is used with the embodiments of FIGS. 3 and 5 and the function of this hydraulic system is readily understood in view of the description above of the hydraulic system of FIG. 7. Further as noted above, the embodiment of FIG. 3 may include a turntable and the embodiment of FIG. 5 can also include a turntable. Such a turntable is shown in the hydraulic system of FIG. 12.

By suitable actuation of valve 1 hydraulic fluid under pressure from pump 69 either extends or retracts turntable 63 into or out of operative position. Suitable manual actuation of valve 2' will actuate hydraulic piston 49' in cylinder 48' to raise or lower the left conveyor while suitable actuation of valve 3' will energize or de-energize piston 49'' in hydraulic cylinder 48'' to raise or lower the center conveyor 118 of the embodiment of FIG. 5 and, as before, suitable manual actuation of valve 2 acting on hydraulic cylinder 48 and piston 49 will raise or lower the right conveyor 35 in the embodiments of FIGS. 3 and 5. Conveyor 66 to dump hopper 27 is actuated, as before, by suitable positioning of valve 5 to rotate motor 67 in the desired direction to move the conveyor to selectively dump on one side or the other of the vehicle.

The operation of the vehicle in accordance with the present invention is readily understood from the above description of the three embodiments thereof but will be briefly summarized with respect to the preferred embodiment of FIGS. 1, 2, 6-11. With the vehicle of this embodiment mounted on existing standard gauge rails, the operator starts motor 68 and pump 69 then provides hydraulic fluid under pressure which by suitable actuation of valve 97 of FIG. 6 drives main motor 94 to move the vehicle down the tracks to the work area. On reaching the work area where one of the rails has been removed, the operator by appropriate manipulation of valve of FIG. 7, lowers either crawler 55 or crawler 52 into downward position to take the weight of the vehicle on that side and then actuates valve 2 to raise conveyor 35 above the level of chassis 20 so that proper actuation of valve 3 will move conveyor 35 across the chassis 20 to the side where the crawler is lowered and the rail has been removed. Suitable actuation of valve 97 then activates main motor 94 which drives the vehicle forward also energizing the down crawler through the drive mechanism of FIGS. 8, 9, 10 and 11. Actuation of valve 2 lowers conveyor 35 about its pivot 36 so that the lower end thereof comes adjacent the roadbed and conveyor motor 44 drives conveyor belt 41 at the same speed as that of the vehicle while magnets 47 acting through conveyor belt 41 pick up any magnetic articles and discharge them into hopper 27.

When the work area has been covered, the vehicle is stopped and by suitable actuation of valve 1 the operator lowers turntable 63 to lift the vehicle off of the track and off of the down crawler. Conveyor 35 is lifted to a level above chassis 20 and the vehicle may then be rotated about the turntable to bring the opposite wheels above the existing rail and the down crawler is raised and the opposite crawler is then lowered. Valve 1 is actuated to raise turntable 63 and the vehicle is lowered so that the wheels engage the existing rail and the down crawler engages the roadbed. Motor 33 is then actuated to move conveyor 35 across the vehicle on tracks 28 and 29 to the opposite side and conveyor 35 is lowered into working position. Valve 97 is then actuated to energize main motor 94 and conveyor motor 44 and the vehicle returns over the working area picking up any magnetic articles which may have been missed.

Hopper 27 may be discharged by energizing conveyor 66 at any desired time either into another vehicle or to pile the magnetic articles in one place beside the roadbed.

The same mode of operation is performed for the embodiments of FIGS. 3 and 5 but in these embodiments, of course, conveyor 35 does not move across the vehicle and the several conveyors are driven synchronously.

What is claimed is:

1. A vehicle for collecting magnetic articles from a railroad roadbed having spaced railway rails comprising a chassis, wheels for said chassis for engaging said rails, a source of hydraulic fluid under pressure on said chassis, a main hydraulic motor connected to said source driving at least one of said wheels, a hopper on and extending across said chassis, spaced tracks on and extending across said chassis adjacent said hopper, a carriage mounted on said tracks, a first hydraulic motor connected to said source for moving said carriage on said tracks from a side of said chassis to the opposite side thereof, an endless conveyor of non-magnetic material, a pivot mounting said endless conveyor on said carriage, hydraulic piston and cylinder means connected to said source and to said carriage and to said endless conveyor for raising and lowering said endless conveyor about said pivot with respect to the roadbed and also to said carriage and said chassis, said endless conveyor passing over a roller at an end adjacent the roadbed when in operating position, a plurality of permanent magnets in said roller, said endless conveyor discharging into said hopper, a second hydraulic motor connected to said source for driving said endless conveyor at the same speed as said vehicle, a frame downwardly depending from each side of said chassis and pivotally mounted on said chassis, hydraulic means for swinging each of said frames from an upper to a lower position connected to said source, crawler means mounted on each of said frames, and mechanical drive means connected to the at least one wheel for selectively driving the crawler means of the frame in lower position whereby when said vehicle is moved over a rail and a crawler is in lower position said crawler supports and moves said vehicle on one side and when said endless conveyor is lowered and actuated said magnets will draw magnetic articles from the roadbed onto said endless conveyor for movement to and discharge into said hopper.

2. A vehicle as described in claim 1, said mechanical drive means including a clutch disengaged when a frame is in upper position and engaged when a frame is in lower position.

3. A vehicle for collecting magnetic articles from a railroad roadbed having spaced railway rails comprising a chassis, wheels for said chassis for engaging said rails, a source of hydraulic fluid under pressure on said chassis, a main hydraulic motor connected to said source driving at least one of said wheels, a carriage mounted on said chassis, an endless conveyor of non-magnetic material at a side of said chassis, a pivot mounting said endless conveyor on said carriage, hydraulic piston and cylinder means energized by said source connected to said carriage and to said endless conveyor for raising and lowering said endless conveyor about said pivot with respect to the roadbed and also to said carriage and said chassis, said endless conveyor passing over a roller at an end adjacent the roadbed when in operating position, a plurality of permanent magnets in said roller, said endless conveyor discharging onto said vehicle a second hydraulic motor connected to said source for driving said endless conveyor at the same speed as said vehicle, a frame downwardly depending from each side of said chassis and pivotally mounted on said chassis, hydraulic means for swinging each of said frames from an upper to a lower position energized by said source, crawler means mounted on each of said frames and mechanical drive means connected to the at least one wheel for selectively driving the crawler means of the frame in lower position whereby when said vehicle is moved over said rails and said endless conveyor is lowered and actuated said magnets will draw magnetic articles from the roadbed onto said endless conveyor for movement to and discharge into said hopper.

4. A vehicle as described in claim 3, said mechanical drive means including a clutch disengaged when a frame is in upper position and engaged when a frame is in lower position.

* * * * *